United States Patent [19]

Ramirez et al.

[11] 3,996,701

[45] Dec. 14, 1976

[54] LENS BLOCK WITH PREFORM

[75] Inventors: Peter R. Ramirez, Southbridge; Bertram R. Goodwin, Feeding Hills, both of Mass.

[73] Assignee: American Optical Corporation, Southbridge, Mass.

[22] Filed: June 30, 1975

[21] Appl. No.: 591,670

[52] U.S. Cl. ..... 51/216 LP; 51/277

[51] Int. Cl.[2] ..... B24B 13/00

[58] Field of Search ..... 51/216 LP, 277; 164/112; 425/808

[56] References Cited

UNITED STATES PATENTS

| | | | |
|---|---|---|---|
| 3,118,225 | 1/1964 | McAndrews | 164/112 |
| 3,383,808 | 5/1968 | Deshayes | 51/216 LP |
| 3,512,310 | 5/1970 | Rudd | 51/277 |

*Primary Examiner*—Harold D. Whitehead
*Attorney, Agent, or Firm*—H. R. Berkenstock, Jr.; William C. Nealon

[57] ABSTRACT

A lens block having locating bosses for fixturing to lens-surfacing equipment and an interconnected oppositely disposed lens holding portion all cast of a eutectic blocking medium. The blocking medium is cast over and through an apertured preform of rigid, relatively high melting temperature material functioning as a heat sink and material filler.

5 Claims, 6 Drawing Figures

LENS BLOCK WITH PREFORM

BACKGROUND OF THE INVENTION

1. Field of the Invention

This invention relates to the blocking of lenses for surfacing, edging or other finishing operations and has particular reference to improvements in blocks formed of eutectic materials which are cast in situ.

2. Discussion of the Prior Art

Lens blocking for surfacing and other finishing operations can be performed with exceptional ease and precision by casting blocks in place in a cavity defined on one side by the lens and all other sides by mold surfaces.

Eutectic metal alloys are preferred blocking media in view of their ease of handling, neatness in operation, sturdiness in use, and ease of removal and reclaim.

By such means, a fresh, i.e. completely newly formed, block is provided for the working of each lens thereby obviating the tedious, time-consuming and costly block cleaning, trueing, rebuilding and/or replacement of old art cast iron or steel blocks, not to mention the elimination of messy blocking adhesives such as pitch and associated apparatuses such as heating kettles and dispensers.

Heretofore, however, cast eutectic metal alloy blocks and blocking techniques have been beset with problems of overcoming the high cost of blocking materials without sacrifice of block strength.

An insufficiency of blocking material permits lens deformation and/or breakage under pressures of surfacing operations with attending high scrap yields while, on th other hand, greater amounts of blocking material and/or the use of higher eutectic point (more rigid) materials for greater block strength respectively increase material cost and the chances of heat deformation, cracking or other damaging of lenses. The latter, i.e. greater amounts and/or higher eutectic point materials, may be more deleterious to plastic lenses but are not without tendency to damage glass lenses, especially those of thinner cross-sections. The use of larger amounts of blocking material also increases costly oxidation and spill losses.

The foregoing and related drawbacks of prior art cast lens blocks and blocking techniques are overcome by the present invention wherewith high block rigidity may be accomplished with minimal amounts of casting material per block and a uniquely low transfer of heat to lenses being blocked.

It is, accordingly, a principal object of the invention to provide improved lens blocks and method of blocking lenses for fixturing to lens working equipment.

SUMMARY OF THE INVENTION

The foregoing objective and its corollaries are accomplished by providing an apertured block preform of relatively rigid, shape-retaining and heat-absorbent material over and through which a eutectic blocking material is cast to the finished outer configuration desired of the lens block. The preform is placed within the casting cavity of a blocking mold which is defined on one side by a lens to be blocked and, on all other sides, by the internal surfaces of the mold. The latter surfaces are configured to the shape desired of locating bosses to be formed upon a block for fixturing to surfacing equipment. Apertures through the preform permit the casting eutectic to flow from the confines of the mold surfaces against the lens being blocked and vice-versa, encasing the preform and attaching the lens to the resulting block.

Upon solidification of the casting eutectic, by cooling, the block-preform-lens unit is ejected from the mold.

The encased preform serves dually as a filler to minimize the amount of casting eutectic needed to complete the lens block and as a heat sink during mold casting. This permits the use of less expensive and more durable higher melting temperature casting eutectics without adverse effect upon lenses being blocked.

Details of the invention will become more readily understood by reference to the following description when taken in conjunction with the accompanying drawings.

DESCRIPTION OF THE PREFERRED EMBODIMENTS

Figure 1:
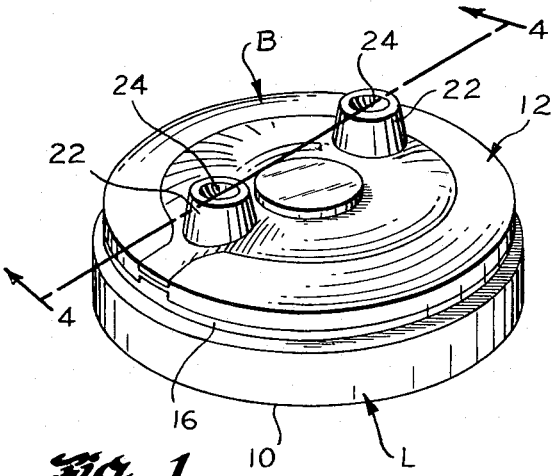
FIG. 1 is an illustration, in perspective, of one embodiment of the invention.

In FIG. 1, there is illustrated an embodiment of the invention comprising block B cast upon lens L. The lens is thus rendered adaptable to fixturing in polishing equipment for working of its exposed surface 10. Those interested in details of the use of cast lens blocks and ways of fixturing the same in lens surfacing apparatuses may refer to U.S. Pat. Nos. 3,118,198; 3,152,427; and 3,195,197.

Block B comprises an encased preform 12 (FIG. 4) having a pair of openings 14 through which a eutectic casting medium extends to form at opposite sides of the preform a lens holding portion 16 having face 18 attached to surface 20 of lens L and bosses 22 having internal sockets 24 for fixturing the blocked lens to surfacing equipment.

Casting media known to produce desirable results are metal alloys of types such as Wood's alloy or others known in the trade as Cerrolow and Cerrobend sold by Cerro Metal Products, Division of Cerro Corporation. Cerrolow and Cerrobend have melting points between approximately 45° C and 70° C. Wood's alloy is usually of slightly higher melting temperature, e.g. between 66° C and 74° C.

Preform 12 is preferably of such diametral size and thickness as to make up the major portion of finished block B, i.e. excepting bosses 22 and lens holding porton 16. It is further preferred that preform 12 be constructed of a reuseable shape-retaining and heat-absorbing material which is readily cleanly separable from the block casting medium during lens deblocking or subsequent thereto. Molded or machined polycarbonate or polycarbonate filled with glass fiber has been found to produce desirable results. Polyethylene, polypropylene or polyacetal materials may also be used.

Figure 3:
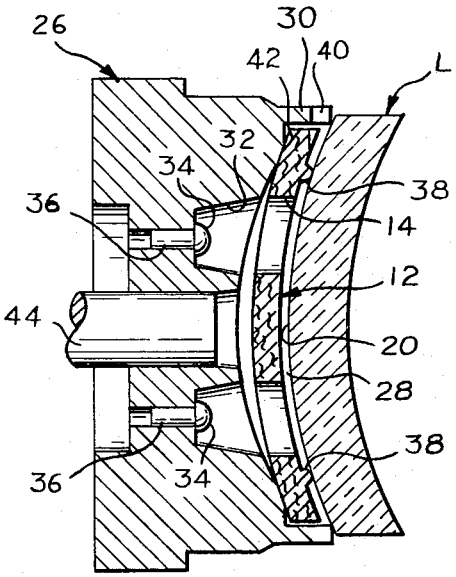
FIG. 3 is a cross-sectional view of apparatus used to perform the block casting operation, the preform of FIG. 2 and a lens to be blocked being shown in positions of readiness for blocking.

The lens blocking operation is performed with a block casting mold, one form of which is illustrated in FIG. 3.

Mold 26 is provided with casting cavity 28 having rim 30 against which a lens L to be blocked is seated as illustrated. Surface 20 of lens L thus closes cavity 28 and defines one of its sides. Oppositely of surface 20, cavity 28 is provided with recesses 32 of the shape and size desired of bosses 22 to be formed upon block B. Inwardly of recesses 32, heads 34 of pins 36 produce the aforementioned sockets 24 of blocks cast in cavity 28.

Preceding the placement of a lens L against rim 30 for blocking, preform 12 is inserted into cavity 28 as shown in FIG. 3. Nibs 38 on preform 12 space the preform inwardly of cavity 28 sufficiently away from lens surface 20 to produce the thin lens-holding portion 16 of block B when cavity 28 is filled with a block casting medium.

Figure 2:
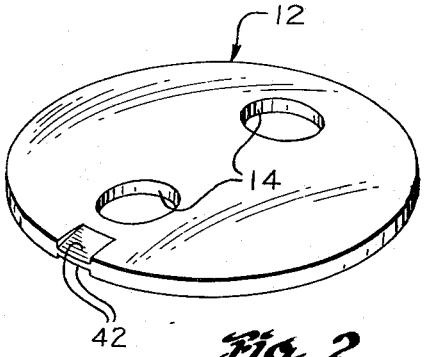
FIG. 2 is an illustration, in perspective, of a preform which is used in a block casting operation performed according to the invention.
Figure 4:
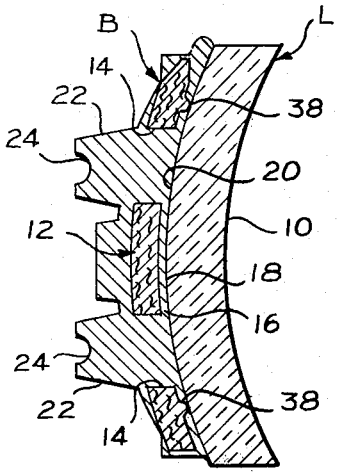
FIG. 4 is a cross-sectional view taken generally on line 4—4 of FIG. 1.

Filling port 40 is provided in rim 30 and, with lens L clamped against rim 30, the blocking medium (preferably a molten eutectic metal alloy) is poured therethrough into cavity 28. A notch 42 (FIG. 2) formed in one or both sides of preform 12 adjacent its edge and aligned with filling port 40 facilitates the flow of metal alloy into the casting cavity. The alloy flows downwardly into the space between lens surface 20 and preform 12, through openings 14 and into recesses 32 or vice-versa to encase preform 12. This completes block B with a minimal amount of alloy as depicted in FIG. 4.

Preform 12, acting as a heat sink, prevents overheating of lens L by the molten alloy and the thus cast block B is cooled in mold 26 until solidified whereupon it is ejected, e.g. by means of plunger 44. Lens L is attached to block B by interfacial adhesion of its surface 20 with portion 16. However, it is to be understood that surface protecting coatings of polyvinyl chloride-vinyl acetate, for example, may be used upon the sides of lenses to be blocked and that, in such cases, blocks B would be formed against the coating.

Figure 5:
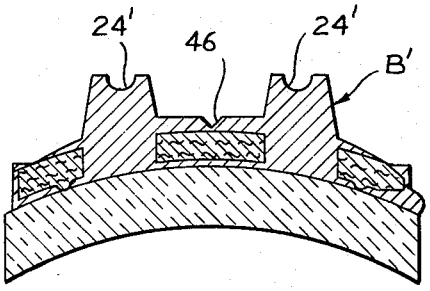
FIG. 5 is a cross-sectional view of a modification of the invention.

A modification of the invention is shown in FIG. 5 wherein block B′ is provided with a centrally disposed fixturing socket 46 which, for purposes of illustration, has been shown as being conical. Socket 46 may, alternatively, be semicircular, if desired. Sockets 24′ also being provided in block B′ render the block universally adaptable to spherical lens surfacing apparatuses by fixturing in socket 46 and toric surfacing apparatuses by fixturing in sockets 24′.

The aforementioned U.S. Pat. Nos. 3,118,198; 3,152,427; and 3,195,197 illustrate the use of both types of fixturing and may be referred to for greater detail on the subject. Proper fixturing techniques, however, are generally well known and understood in the art.

Upon completion of a lens surfacing operation, lenses L (FIGS. 1–4) of L′ (FIG. 5) may be deblocked conventionally. They may be "picked" from blocks B or B′, released by chilling or by melting of the cast alloy or by whatever other means or method is deemed most appropriate or desirable. In all cases, however, separation of the encased preform from the casting medium for the reuse of each is preferably accomplished by heating the combination after deblocking to a temperature equal to or above the melting temperature of the casting medium. Immersion of used blocks B or B′ in hot water produces desirable results.

Figure 6:
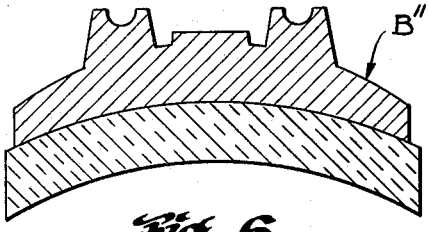
Fig. 6 (PRIOR ART)
FIG. 6 is a cross-sectional view of a lens blocked according to prior art teachings wherewith, by its comparison with FIGS. 1, 4 and 5 in particular, the distinctiveness of the present invention can be more easily understood.

Typical of prior art cast eutectic alloy blocks is block B″ of FIG. 6. Comparing block B″ with either of blocks B or B′ (FIGS. 3 or 4), the substantial savings of block casting material afforded by the present invention becomes readily apparent. This represents a long-sought large reduction in lens blocking cost by substantial savings in the overall amount of eutectic material needed to support factory or laboratory lens surfacing operations. Oxidation, spill and contamination losses are also reduced by amounts according to the reduction of overall amounts of eutectic material needed.

Equally importantly, the use of preforms 12 reduce costly lens scrap by absorbing large portions of potentially damaging heat from the molten block casting material in which they become encased. Lens distortion and/or fracturing by thermal shock is minimized, if not completely eliminated. Still further, the use of preforms 12 which function as heat sinks, makes possible the use of less expensive and more durable higher melting temperature eutectics.

Those skilled in the art will readily appreciate that various modifications and adaptations of the precise forms of the invention here shown for purposes of illustration may be made to suit particular requirements. It is, accordingly, intended that such modifications which incorporate the novel concept disclosed are to be construed as coming within the scope of the claims or the range of equivalency to which they are entitled in view of the prior art.

We claim:

1. A lens block comprising a preform of rigid high melting temperature heat-absorbent non-metallic material, said preform being apertured; and cast lens-holding and fixturing portions of metal of low melting temperature eutectic composition at each of opposite sides of said preform, said cast portions encasing all sides of said preform and extending through said apertures in interconnecting relationship with said lens-holding and fixturing portions, said fixturing portion comprising at least one boss having a fixturing socket means formed therein.

2. A lens block according to claim 1 wherein said preform is constructed of a polycarbonate material.

3. A lens block according to claim 1 wherein said polycarbonate material is filled with glass fiber.

4. A lens block according to claim 1 wherein said lens holding portion comprises a thin layer of said metal.

5. The combination of a lens and block attached to one side of said lens for fixturing said lens to surfacing apparatus wherein said block comprises an apertured preform of rigid high melting temperature heat-absorbent non-metallic material and cast holding and fixturing portions of metal of low melting temperature eutectic composition encasing all sides of said preform and extending through said apertures in interconnecting relationship with said less-holding and fixturing portions, said lens-holding portion comprising a thin layer of said eutectic composition and said fixturing portions comprising at least one boss having a fixturing socket formed therein, said thin layer being interfacially joined to said one side of said lens and interconnected with said boss through said aperture preform.

* * * * *